US007705791B2

(12) United States Patent
Ollikainen

(10) Patent No.: US 7,705,791 B2
(45) Date of Patent: Apr. 27, 2010

(54) ANTENNA HAVING A PLURALITY OF RESONANT FREQUENCIES

(75) Inventor: Jani Ollikainen, Helsinki (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 12/151,293

(22) Filed: May 5, 2008

(65) Prior Publication Data

US 2008/0211725 A1 Sep. 4, 2008

Related U.S. Application Data

(62) Division of application No. 11/107,159, filed on Apr. 15, 2005, now Pat. No. 7,629,931.

(51) Int. Cl.
*H01Q 1/24* (2006.01)

(52) U.S. Cl. ..... 343/702

(58) Field of Classification Search ..... 343/702, 343/700 MS, 728, 866, 741–742
See application file for complete search history.

(56) References Cited

U.S. PATENT DOCUMENTS

| | | | | |
|---|---|---|---|---|
| 5,315,309 | A | 5/1994 | Rudow et al. | 343/705 |
| 5,654,724 | A | 8/1997 | Chu | 343/742 |
| 5,764,195 | A | 6/1998 | Colclough et al. | 343/797 |
| 5,880,697 | A | 3/1999 | McCarrick et al. | 343/742 |
| 6,014,107 | A | 1/2000 | Wiesenfarth | 343/742 |
| 6,236,368 | B1 | 5/2001 | Johson | 343/702 |
| 6,597,317 | B2 | 7/2003 | Talvitie | 343/700 MS |
| 6,909,402 | B2 * | 6/2005 | Vance | 343/702 |
| 6,917,335 | B2 * | 7/2005 | Kadambi et al. | 343/700 MS |
| 7,215,293 | B2 | 5/2007 | Chen et al. | 343/741 |
| 7,307,591 | B2 * | 12/2007 | Zheng | 343/702 |
| 2003/0098814 | A1 * | 5/2003 | Keller et al. | 343/742 |
| 2006/0017635 | A1 | 1/2006 | Zheng | 343/748 |
| 2008/0042916 | A1 * | 2/2008 | Ma | 343/767 |
| 2008/0211725 | A1 * | 9/2008 | Ollikainen | 343/749 |

OTHER PUBLICATIONS

Jani Ollikainen et al., "Internal Dual-Band Patch Antenna for Mobile Phones", 2000 European Space Agency (ESA), Proceedings of the AP2000 Millennium Conference on Antennas & Propagation, Davos, Switzerland, Apr. 9-14, 2000, CD-ROM SP 444, paper p 1111.pdf.
Juha Villanen et al., "Compact Antenna Structures For Mobile Handsets", Mar. 2003 IEEE, pp. 40-44.
Pertti Vainikainen et al., "Resonator-Based Analysis Of The Combination Of Mobile Handset Antenna And Chassis", IEEE Transactions on Antennas and Propagation, vol. 50, No. 10, Oct. 2002, pp. 1433-1443.

* cited by examiner

*Primary Examiner*—Huedung Mancuso
(74) *Attorney, Agent, or Firm*—Harrington & Smith

(57) ABSTRACT

An antenna having a plurality of resonant frequencies and including a ground plane having an edge; a feed point; a ground point; and an antenna track extending between the feed point and the ground point and comprising, in series connection, a first loop and a second loop wherein a least a portion of the first loop and a portion of the second loop are adjacent at least the edge of the ground plane.

19 Claims, 5 Drawing Sheets

ANTENNA HAVING A PLURALITY OF RESONANT FREQUENCIES

CROSS-REFERENCE

This patent application is a divisional application of U.S. application Ser. No. 11/107,159, filed Apr. 15, 2005 now U.S. Pat. No. 7,629,931, the disclosure of which is incorporated by reference in its entirety.

FIELD OF THE INVENTION

Embodiments of the present invention relate to an antenna having a plurality of resonant radio frequencies. Some embodiments relate to an internal multi-band antenna for use in a hand-held telecommunication device, such as a mobile cellular telephone.

BACKGROUND TO THE INVENTION

Current wireless communication systems utilize several different radio communication standards and operate at many different frequency bands. In this fractured service environment, terminals operating in multiple systems and frequency bands offer a better service coverage. A multi-band antenna is a key component of a multi-band mobile terminal. It may also be used in a base station.

One example of a multi-band communication terminal is a mobile cellular telephone operable in any one of the four GSM system bands i.e. GSM850 (824-894 MHz), GSM900 (880-960 MHz), GSM1800 (1710-1880 MHz), GSM1900 (1850-1990 MHz). It is very challenging to design a compact internal antenna that operates at some or all of these frequency bands and has a good total efficiency.

In current mobile cellular telephones, various components such as a camera, a speaker or both have often been located at least partly between the internal antenna element and its ground plane. These additional components can degrade the antenna performance.

The user's hand, if brought close to the antenna, typically degrades the performance of the antenna at these frequency ranges. The effect is very strong when the hand is at least partly on top of the antenna. A user often holds a mobile cellular telephone so that a forefinger is on top of the antenna element near the top of the cellular telephone.

It would be desirable to provide an improved antenna.

BRIEF DESCRIPTION OF THE INVENTION

According to one embodiment of the invention there is provided an antenna having a plurality of resonant frequencies and comprising: a ground plane having a first edge and a further edge; a feed point; a ground point; and an antenna track extending between the feed point and the ground point and comprising, in series connection, a first loop and a second loop, wherein a portion of the first loop is adjacent the first edge of the ground plane and a portion of the second loop is adjacent the first or the further edge of the ground plane.

"Adjacent" means neighboring. An edge of the portion of the first loop may neighbor the first edge by overlying the first edge within a tolerance of a few millimeters and an edge of the portion of the second loop may neighbor the further edge by overlying the further edge within a tolerance of a few millimeters.

Typically the ground plane has a length and a width and comprises first and second edges extending across the width and separated by the length and third and fourth further edges extending along the length and separated by the width.

The antenna track may be unitary, alternatively it may be composed of one or more distinct antenna tracks with or without additional circuitry.

The antenna may thus be located around the edges of the ground plate and the housing of the device in which it is located. This leaves a center area of the antenna and device free to implement other cellular telephone functions such as a camera or a speaker. It also prevents the antenna underlying the area where a user is likely to place a finger.

The positioning of the antenna track allows the antenna to couple strongly to the resonant modes of the ground plane. This enables the antenna to have very large operation bandwidths and high total efficiencies compared to its electrical size (electrical volume occupied by the antenna) at all operation bands. The antenna shape and suitable reactive loading may be used to make the second band dual-resonant and thus inherently more wideband.

According to one embodiment of the invention there is provided an antenna having a plurality of resonant frequencies and comprising: a ground plane; a feed point; a ground point; and an antenna track, of length L, extending between the feed point and the ground point and comprising, in series connection, a first loop and a second loop, wherein the first loop has a return bend between L/5 and 2L/5 from the ground point and the second loop has a return bend between 3L/5 and 4L/5 from the ground point.

According to one embodiment of the invention there is provided an antenna having a plurality of resonant frequencies and comprising: a ground plane; a feed point; a ground point; an antenna track, of length L, extending between the feed point and the ground point and comprising, in series connection, a first loop and a second loop, wherein the first loop has a return bend between L/5 and 2L/5 from the ground point and the second loop has a return bend between 3L/5 and 4L/5 from the ground point; and capacitive loading between 2L/5 and 3L/5 from the ground point.

There may also be capacitive loading elsewhere. In one embodiment, the majority of capacitive loading is between 2L/5 and 3L/5.

The reactive loading, whether inductive loading such as bends or capacitive loading, may be used to make a second band of the antenna dual-resonant and thus inherently more wideband.

According to another embodiment there is provided an antenna having a plurality of resonant frequencies and comprising: a ground plane; a feed point; a ground point; and an antenna track extending between the feed point and the ground point and comprising, in series connection, a first loop and a second loop and having a first continuous band of operation and a second continuous band of operation, wherein the first continuous band of operation corresponds to a fundamental resonant frequency (first harmonic resonance) of the antenna and the second continuous band of operation corresponds to the second and third harmonic resonances of the fundamental resonance of the antenna, wherein the third harmonic is tuned, using reactive loading, towards the second harmonic.

The antenna may be shaped and arranged so that the fundamental resonance and the second and third harmonic resonances couple strongly to one or more resonances of the ground plane.

In one embodiment, the ground plane has a first edge and a further edge and the coupling of the fundamental resonance and the second and third harmonic resonances to one or more resonances of the ground plane is achieved by arranging the antenna so that a portion of the first loop is adjacent the first edge of the ground plane and a portion of the second loop is adjacent the first or the further edge of the ground plane.

However, in other embodiments the antenna can extend mostly or even totally outside the ground plane.

According to another embodiment there is provided an antenna having a plurality of resonant frequencies and comprising: a ground plane having an edge; an antenna track comprising an edge wherein at least a portion of the antenna edge is adjacent the ground plane edge; and reactive loading of the antenna track.

The positioning of the antenna track allows the antenna to couple strongly to the resonant modes of the ground plane. This enables the antenna to have very large operation bandwidths and high total efficiencies compared to its electrical size (electrical volume occupied by the antenna) at all operation bands. The reactive loading may be used to make the second band dual-resonant and thus inherently more wideband.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
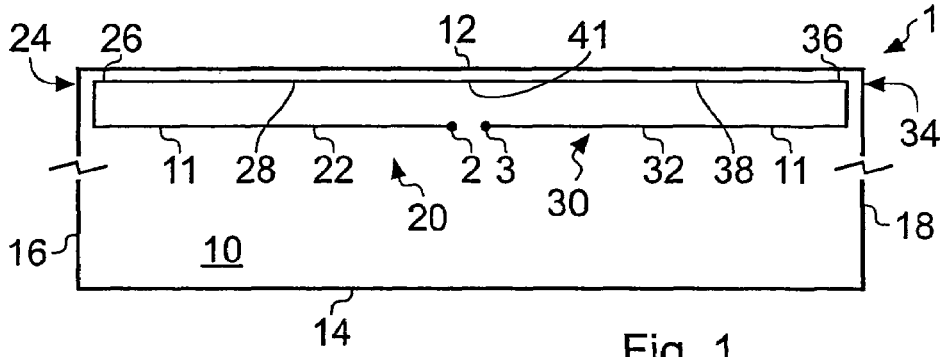
FIGS. 1, 2 and 3 illustrate multi-band antennas according to different embodiments of the invention.
Figure 2A:
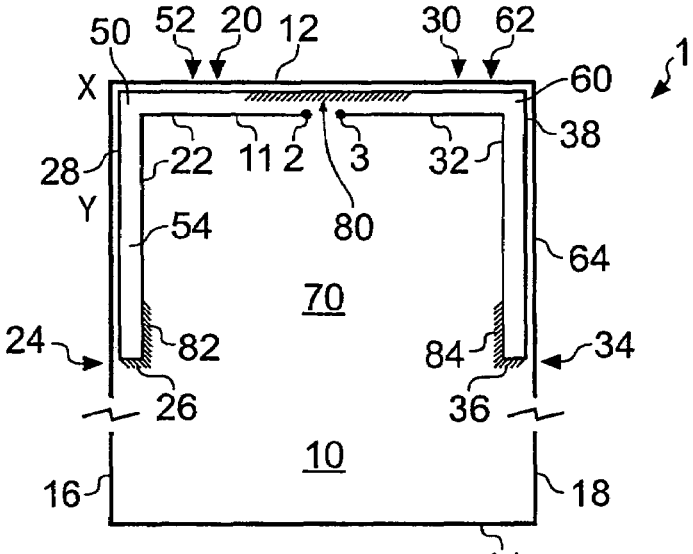
Figure 2B:
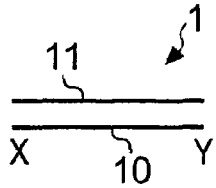
Figure 3A:
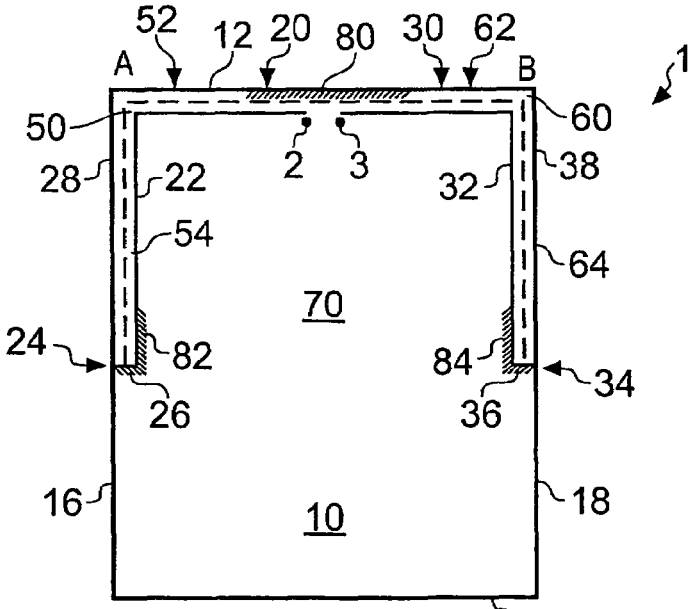
Figure 3B:
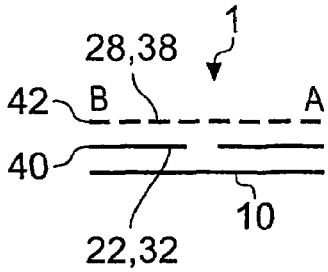

The FIGS. 1, 2 and 3 illustrate a microstrip antenna 1 that is short circuited at one end and fed at the other end. The antenna 1 comprises: a ground plane 10 having an edge 12; a feed point 2; a ground point 3; and an antenna track 11, of length L, extending between the feed point 2 and the ground point 3 and comprising, in series connection, a first loop 20 and a second loop 30 wherein at least a portion of the first loop 20 and a portion of the second loop 30 are adjacent at least the edge 12 of the ground plane. A dielectric substrate can be positioned between the antenna track 11 and the ground plane 10 and typically provides support for the antenna track 11. The dielectric substrate can, at least partly, be air.

The first and second loops 20, 30 may be but are not necessarily the same length L/2. The first loop 20 comprises a first antenna track portion 22 extending from the feed point 2 to a first extremity 24, a return bend 26 at the first extremity 24 and a second antenna track portion 28 returning from the first extremity 24 towards the feed point 2. The second loop 30 comprises a third antenna track portion 32 extending from the ground point 3 to a second extremity 34, a return bend 36 at the second extremity 34 and a fourth antenna track portion 38 returning from the second extremity 34 towards the ground point 3. The second antenna track portion 28 and fourth antenna track portion 38 are interconnected at point 41. There is, in the illustrated examples, a constant separation between the first and second antenna track portions 22, 28 and between the third and fourth antenna track portions 32, 38. However, the separation between the first antenna track portion 22 and the second antenna track portion 28 and the separation between the third antenna track portion 32 and the fourth antenna track portion 38 may be independently varied. This allows the coupling between the antenna track portions to be controlled and thus the ratios of the fundamental and harmonic resonant frequencies to be controlled.

Although the antenna has been described as interconnected loops 20, 30 it should be understood that the antenna track 11 may be made from a single, unitary element.

The first 22, second 28, third 32 and fourth 38 antenna track portions may be co-planar as illustrated in FIGS. 1 and 2. Alternatively the first 22 and third 32 antenna track portions may lie in a first lower plane 40 while the second and fourth antenna track portions lie in a second upper plane 42 as illustrated in FIG. 3.

In FIGS. 2 and 3, the first and second antenna track portions 22, 28 extend laterally to a first bend 50 to form a lateral portion 52 of the first loop 20 and then extend longitudinally to the first extremity to form a longitudinal portion 54 of the first loop 20. The third 32 and fourth 38 antenna track portions extend laterally to a second bend 60 to form a lateral portion 62 of the second loop 30 and then extend longitudinally to the second extremity 34 to form a longitudinal portion 64 of the second loop 30. In the illustrated example, the bends 50 and 60 are substantially right-angled, however, other angled bends may be used. The illustrated antenna 1 consequently has a U shape.

The length of the longitudinal portions 54, 64 are greater than the length of the lateral portion 52, 62 but less than twice the length of the lateral portions 52,62. In one example, the lateral portions 52, 62 are approximately 20 mm long and the longitudinal portions 54, 64 are approximately 30 mm long. In this example the ground plane is 110 mm long and 40 mm wide. The longitudinal portions 54, 64 of the first and second loops are physically separated and define a volume 70 between them and over the ground plane 10 that is unused by the antenna 1.

The lateral portions 52, 62 and the longitudinal portions 54, 64 can but need not completely overlie the ground plane 10.

The antenna 1 has several resonances. By adjusting the antenna geometry and the relative reactive loading of different antenna track portions, it can be arranged that the antenna has three resonances within the frequency range of interest—the fundamental resonance and its second and third harmonic resonances. The second and third harmonic resonances can be tuned close to each other so that they form a dual resonance and thus a continuous, wider operation band than either one of the resonances alone.

The antenna has a fundamental resonant frequency $f_1$ corresponding to a wavelength $\lambda_1$, where $L=\lambda_1/2$, a second harmonic frequency $f_2$ corresponding to a wavelength $\lambda_2$, where $L=\lambda_2$ and a third harmonic frequency $f_3$ corresponding to a wavelength $\lambda_3$, where $L=3\lambda_3/2$. The frequency $f_1$ is at or about 900 MHz and the frequency $f_2$ is at or about 1800 MHz.

The third harmonic is tuned, using reactive loading, to bring it towards the second harmonic e.g. so that $\lambda_3$ comes close to equaling L. The first resonance thereby covers the GSM 850 band and/or GSM900 band and the second and third resonance cover the GSM 1800 band and/or GSM1900 band.

The reactive loading comprises a first inductive load located at a position where the electric current associated with the third harmonic is greater than the electric current associated with the second harmonic. Inductive loading can be achieved, for example, by bending the antenna track or by a local decrease in antenna track width or even by adding an inductor.

Figure 5A:
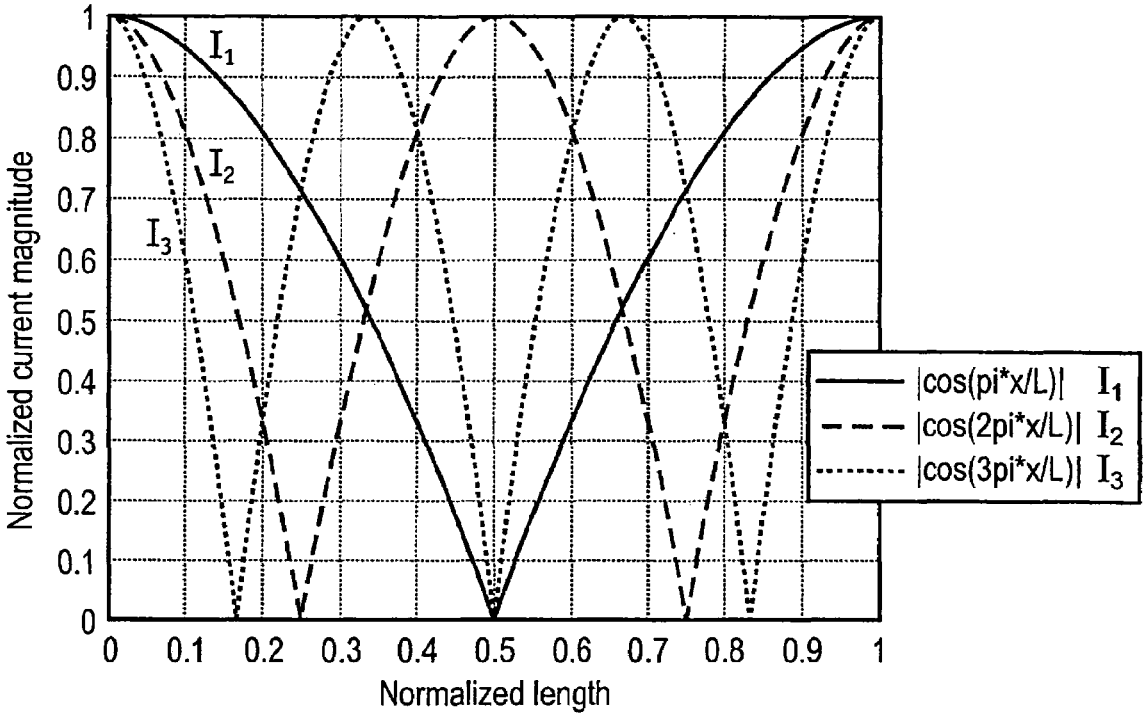
FIG. 5A plots the model currents $I_1$, $I_2$, and $I_3$ for the resonant modes of the antenna and FIG. 5B plots the model Electric field strengths $E_1$, $E_2$, and $E_3$ for the resonant modes of the antenna.

If the electric current $I_1$ for the first resonant mode at a distance x from the ground point is modeled as $A.\cos(\pi x/L)$, the electric current $I_2$ for the second resonant mode at a distance x from the ground point is modeled as $A.\cos(2\pi x/L)$, and the electric current $I_3$ for the third resonant mode at a distance x from the ground point is modeled as $A.\cos(3\pi x/L)$ then, it can be calculated that the magnitude of $I_2$ is greater than the magnitude of $I_3$ for $x<L/5$, $2L/5<x<3L/5$ and $x>4L/5$. The most significant difference occurs in the region $2L/5<x<3L/5$, at or around L/2 where $I_3$ is close to zero. It can also be calculated that the magnitude of $I_3$ is greater than or equal the magnitude of $I_2$ for $L/5\leqq x\leqq 2L/5$ & $3L/5\leqq x\leqq 4L/5$, the most significant difference occurring at or around L/4 and 3L/4 where $I_2$ is close to zero. FIG. 5A plots the model currents $I_1$, $I_2$, and $I_3$ It is desirable to avoid or reduce unnecessary inductive loading where the magnitude of $I_2$ is greater than the magnitude of $I_3$, as this will increase the separation between the second resonant frequency $f_2$ and the third resonant frequency $f_3$. One form of inductive loading is provided by bends in the antenna track. The illustrated antenna 1 consequently does not have any bends in the region close to x=L/2 and may not have any bends in the region $2L/5<x<3L/5$ although bends in this region may be necessary for the antenna 1 to have a shape that fits within a mobile telephone.

It is desirable to introduce inductive loading, in the regions $L/5\leqq x\leqq 2L/5$ & $3L/5\leqq x\leqq 4L/5$ where the magnitude of $I_3$ is significantly greater than the magnitude of $I_2$, as this reduces the third resonant frequency $f_3$ and brings it towards the second resonant frequency $f_2$ forming an upper band of the antenna. Inductive loading may be provided by having multiple bends in the antenna track within the regions $L/5\leqq x\leqq 2L/5$ & $3L/5\leqq x\leqq 4L/5$. The preferred position for such inductive loading is where the electric current $I_2$ is close to zero, that is close to x=L/4 and 3L/4.

In the examples illustrated in FIGS. 1, 2 and 3, the first inductive load is the return bend 36 located at L/4 (between L/5 and 2L/5) from the ground point 3 and the second inductive load is the return bend 26 located at 3/4L (between 3L/5 and 4L/5) from the ground point 3. The antenna track is without bends where the electrical current associated with the second harmonic is significantly greater then the electric current associated with the third harmonic i.e. in the region between 2L/5 and 3L/5 from the ground point and, in particular, around L/2 from the ground point 3.

The reactive loading may also comprise one or more capacitive loads typically positioned where the electrical field associated with the third harmonic is greater than the electric field associated with the second harmonic. Capacitive loading can be achieved by attaching a vertical plate to the edge of an antenna track or by dielectric loading e.g. using a substrate with (effectively) higher dielectric constant between the ground plane and the antenna track. Alternatively, capacitive loading can be achieved by attaching a plate to the ground plane or to another grounded component (like an RF shield in a mobile telephone) so that the plate forms a capacitor with a desired section of the antenna track. In compact implementations, it is desirable to use a plate that is essentially perpendicular to the ground plane. However, other similar arrangements are also possible. The capacitance is adjusted by varying the separation between the plate and the antenna track as well as the size of the plate. It is also possible to add a capacitor, for example a discrete chip capacitor, between the antenna and its ground plane.

Figure 5B:
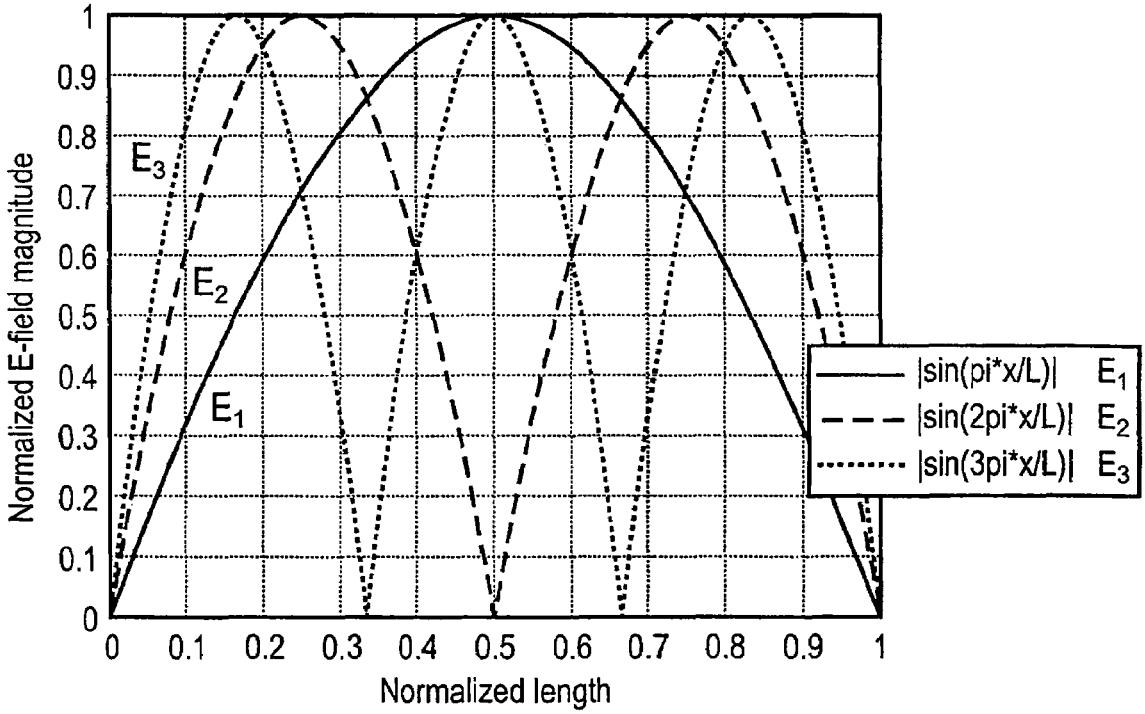

If the electric field $E_1$ for the first resonant mode at a distance x from the ground point is modeled as $B.\sin(\pi x/L)$, the electric field $E_2$ for the second resonant mode at a distance x from the ground point is modeled as $B.\sin(2\pi x/L)$, and the electric field $E_3$ for the third resonant mode at a distance x from the ground point is modeled as $B.\sin(3\pi x/L)$ then, it can be calculated that the magnitude of $E_3$ is greater than the magnitude of $E_2$ for $x<L/5$, $2L/5<x<3L/5$, $x>4L/5$, the most significant difference occurring in the region $2L/5<x<3L/5$, at or around L/2 where $E_2$ is close to zero. It can also be calculated that the magnitude of $E_2$ is greater than or equal the magnitude of $E_3$ for $L/5\leqq x\leqq 2L/5$ & $3L/5\leqq x\leqq 4L/5$, the most significant difference occurring at or around L/3 and 2L/3 where $E_3$ is minimum. FIG. 5B plots the model electric fields $E_1$, $E_2$, and $E_3$ It is desirable to introduce capacitive loading against the ground plane where the magnitude of $E_3$ is greater than the magnitude of $E_2$, as this will decrease the separation between the second resonant frequency $f_2$ and the third resonant frequency $f_3$. One form of capacitive loading is provided by vertical plates attached to the edge of the antenna track. The antenna may consequently have capacitive loading in the region $2L/5<x<3L/5$. The preferred position for the capacitive loading is where the electric field $E_3$ is maximum that is close to x=L/2.

Capacitive loads 82, 84 are added where the magnitude of $E_2$ and $E_3$ are only slightly different from each other, but greater than the magnitude of $E_1$ in order to tune the resonant frequencies of the second and third harmonic relative to the fundamental resonance. Suitable regions for capacitive loads are $L/5\leqq x\leqq L/4$ & $3L/4\leqq x\leqq 4L/5$.

In the examples illustrated in FIGS. 2 and 3, a capacitive load 80 is located at a position between 2L/5 and 3L/5 from the ground point, preferably at L/2 from the ground point. The second and third harmonic resonances (and hence also the centre frequency of the second band of operation) are tuned relative to the fundamental frequency by adding a capacitive load 82 between L/5 and L/4 from the ground point, preferably at L/4, and another capacitive load 84 between 3L/4 and 4L/5 from the ground point, preferably at 3L/4.

Figure 6A:
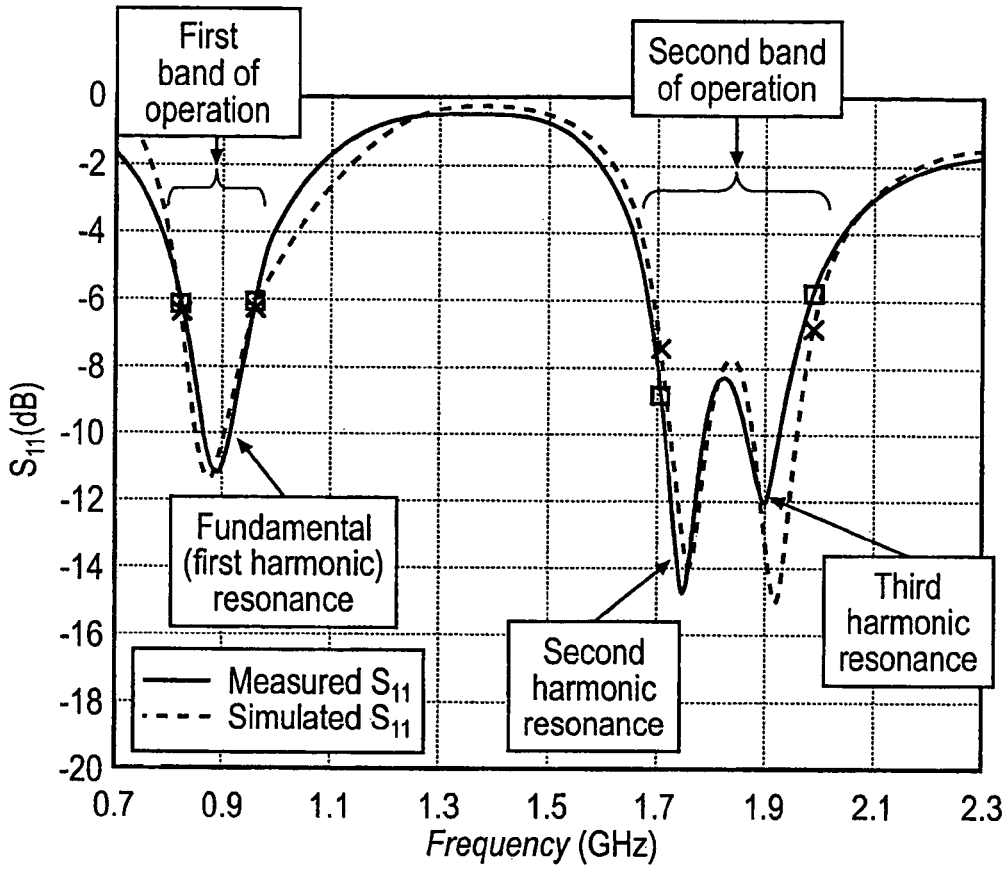
FIG. 6A illustrates a plot of the reflection coefficient vs frequency for the antenna 1 in free space and FIGS. 6B and 6C illustrate the related Smith Charts.
Figure 6B:
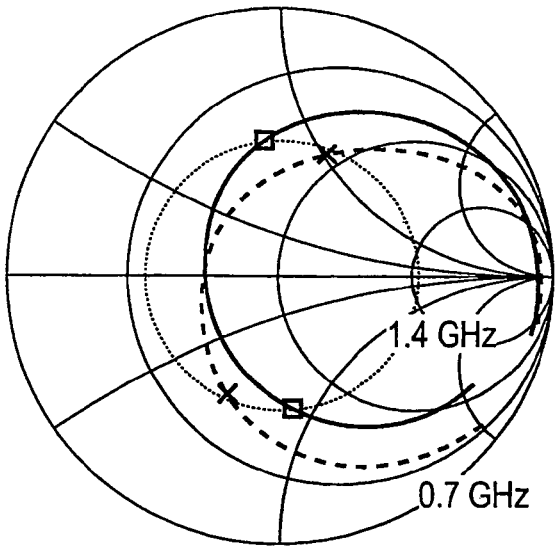
Figure 6C:
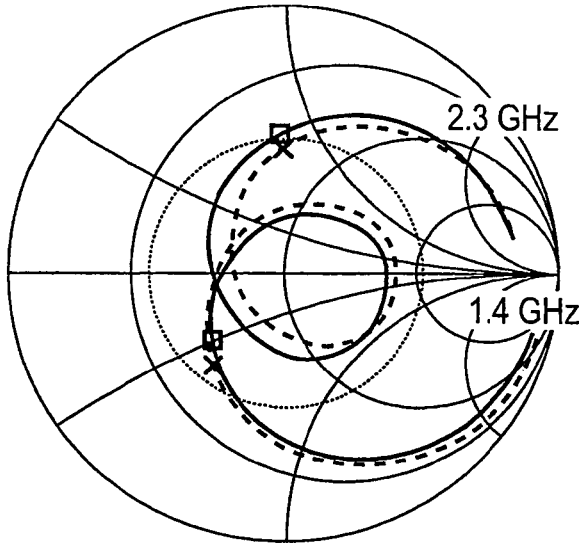

FIG. 6A illustrates a plot of the reflection coefficient vs frequency for the antenna 1 in free space. The plot includes a plot of simulated reflection coefficients and a plot of measured reflection coefficients. The Smith Chart for the antenna's first band of operation is illustrated in FIG. 6B and the Smith Chart for the antenna's second band of operation is illustrated in FIG. 6C.

The coupling between the second and third harmonics can be optimized so that a continuous wide second band of operation is produced. The bandwidth depends upon the size of the small dual resonance loop in the antenna's Smith chart (FIG. 6C). This can be controlled, for example, by adjusting the width of the lateral portions 52, 62 of the first and second loops that are closest to the feed and ground points 2,3. The optimal size is when the loop in the Smith Chart encloses the center of the Smith chart and only barely fits inside a circle representing the matching requirement (e.g. reflection coefficient, $S_{11}<=-6$ dB).

The small dual resonance loop of the antenna's impedance locus on the Smith Chart may be centered by increasing/decreasing the relative length of the first loop 20 to the second loop 30. Increasing the relative length moves the small dual resonance loop clockwise along the impedance locus in the Smith chart and decreasing the relative length moves the small dual resonance loop anti-clockwise along the impedance locus in the Smith chart.

The size of the whole impedance locus and thus also the location of the dual resonance loop can be controlled by adjusting the width of the longitudinal portions 54, 64 of the first and second loops 50, 60 that are closest to the feed and ground points 2, 3. Increasing the width will increase the size of the locus, whereas decreasing the width will decrease it.

Furthermore, the bandwidth of the first (fundamental) resonance can be optimized by having part of the antenna track 11 overlying the ground plane 10 so that the resonant modes of the antenna couple more strongly to the resonant modes of the ground plane 10. This is not always necessary and, in other embodiments, the antenna track 11 may completely overlie the ground plane 10. In other embodiments the antenna track 11 extends mostly or even totally outside the ground plane 10.

The ground plane 10 is, in the illustrated examples, rectangular. It has a length K and a width W. It has a first top edge 12, a second bottom edge 14, a third left side edge 16 and a fourth right side edge 18. The antenna track 11, in FIGS. 2 and 3, is adjacent the first top edge 12 and adjacent a portion of the third left side edge 16, where it meets the first top edge 12, and adjacent a portion of the fourth right-side edge 18, where it meets the first top edge 12.

The ground plane 10 has a well-radiating, low-Q resonances when its effective length is a multiple of $\lambda/2$. For example, a 110 mm long ground plane has resonances at around 1.15 GHz and 2.3 GHz that approximately correspond to wavelengths of 2K and K. Increasing the coupling of the high Q small bandwidth resonant modes of the antenna 1 and low-Q large bandwidth resonant modes of ground plane 10 increases the bandwidth of the resonant modes of the antenna 1. The coupling can be increased by extending the antenna track 11 beyond the ground plane 10 so that it overhangs the ground plane 10 or by cutting away a portion of the ground plane 10 below the antenna track 11.

When the upper and/or left and/or right edge of the antenna is adjacent the respective edges of the ground plane (i.e. within a few millimeters) the coupling between the resonant modes of the antenna and the resonant modes of the ground plane is increased. The bandwidth can be further increased by extending the antenna edge(s) outside the edge(s) of the ground plane. The ground plane has a resonant mode when its effective length is a multiple of $\lambda/2$. The ground plane has multiple (two) resonant frequencies at the approximate frequency range of interest. Whenever the resonant frequency of the antenna approaches or matches one of the resonant frequencies of the ground plane, considerable radiating currents are excited on the ground plane, and the bandwidth of the structure increases.

In FIG. 1, the antenna 1 has return bends 26, 36 at approximately L/4 (within the range $L/5 \leqq x \leqq 2L/5$) and 3L/4 (within the range $3L/5 \leqq x \leqq 4L/5$). There are no bends at x=L/2 nor within the range $2L/5<x<3L/5$. A capacitive load may be added at x=L/2 (within the range $2L/5<x<3L/5$). Capacitive loads may be added where the magnitudes of $E_2$ and $E_3$ are only slightly different, but greater than the magnitude of $E_1$ in order to tune the resonant frequencies of the second and third harmonic relative to the fundamental resonance. Suitable regions for capacitive loads are $L/6 \leqq x \leqq L/4$ & $3L/4 \leqq x \leqq 5L/6$, such as at and just below L/4 and at and just above 3L/4.

The bandwidths of the resonant modes of the antenna are increased by locating the antenna 1 at the first top edge 12 of the ground plane 10. They are further increased by extending the antenna track 11 partly outside the ground plane 10 along the top edge 12. This improves coupling of the high Q small bandwidth resonant modes of the antenna and low-Q large bandwidth resonant modes of the ground plane.

In FIG. 2, the U-shaped, co-planar antenna 1 has return bends 26, 36 at approximately L/4 (within the range $L/5 \leqq x \leqq 2L/5$) and 3L/4 (within the range $3L/5 \leqq x \leqq 4L/5$). There are no bends at x=L/2 nor within the range $2L/5<x<3L/5$. A capacitive load 80 is added at x=L/2 (within the range $2L/5<x<3L/5$). Capacitive loads 82, 84 are added where the magnitudes of $E_2$ and $E_3$ are only slightly different, but greater than the magnitude of $E_1$ in order to tune the resonant frequencies of the second and third harmonic relative to the fundamental resonance. Suitable regions for capacitive loads are $L/5 \leqq x \leqq L/4$ & $3L/4 \leqq x \leqq 4L/5$. The antenna track 11 has a further bend 50 at approximately x=L/10, x=2L/5 and 60 at x=9L/10 and x=4L/5.

The bandwidths of the resonant modes of the antenna 1 are increased by locating the antenna at the edges 12, 16, 18 of the ground plane 10. They are further increased by extending the antenna track 11 outside the ground plane 10 along one or more edges so that it overhangs the ground plane 10. This improves coupling of the high Q small bandwidth resonant modes of the antenna and low-Q large bandwidth resonant modes of the ground plane.

The longitudinal portions of the first and second loops have a length 30 mm and the lateral portions of the first and second loops have approximate lengths 19 mm and 21 mm respectively. The antenna 1 is separated from the ground plane by 7 mm and has a volume of only 4 $cm^3$. The ground plane is 110 mm long and 40 mm wide.

In one embodiment, the upper edge of the antenna track 11 is extended 1 mm over the edge of the ground plane. In another embodiment, the left edge of the antenna track is also extended 1 mm over the left edge of the ground plane and/or the right edge of the antenna track is also extended 1 mm over the edge of the ground plane.

Figure 7:
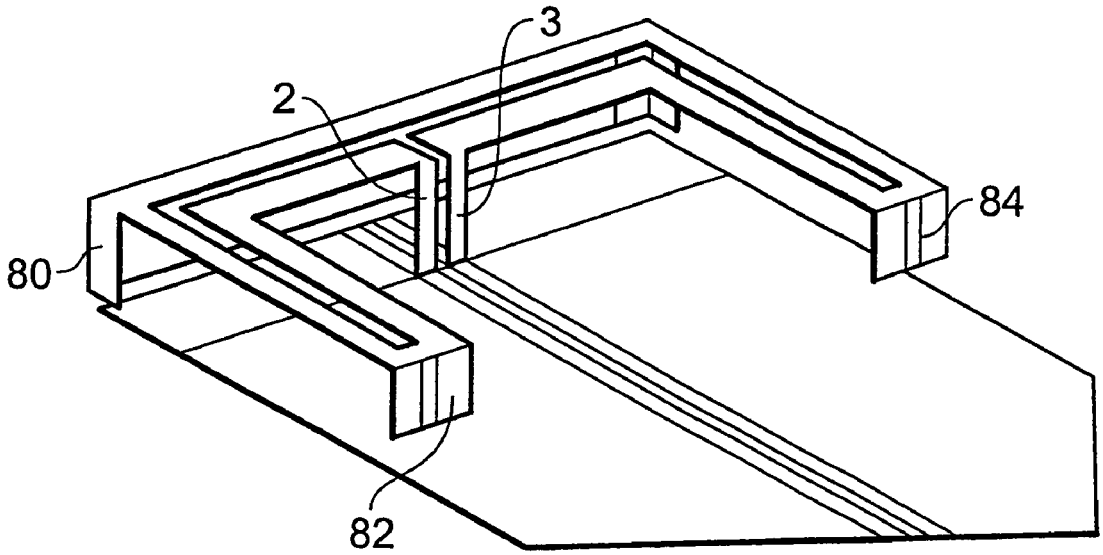
FIG. 7 illustrates one implementation of the U-shaped, co-planar antenna 1 illustrated in FIGS. 2A and 2B.

FIG. 7 illustrates one implementation of the U-shaped, co-planar antenna 1 illustrated in FIGS. 2A and 2B.

In FIG. 3, the U-shaped, antenna 1 has return bends 26, 36 at approximately L/4 (within the range $L/5 \leqq x \leqq 2L/5$) and 3L/4 (within the range $3L/5 \leqq x \leqq 4L/5$). There are no bends at x=L/2 nor within the range $2L/5<x<3L/5$. A capacitive load 80 is added at x=L/2 (within the range $2L/5<x<3L/5$) There is no capacitive load at x=L/4 or x=3L/4. Capacitive loads 82, 84 are added where the magnitude of $E_2$ differs only slightly from the magnitude of $E_3$ i.e. in the regions $L/6 \leqq x \leqq L/4$ & $3L/4 \leqq x \leqq 5L/6$.

The antenna track has a further bend 50 at approximately x=L/10, x=2L/5 and another bend 60 at approximately x=9L/10 and x=4L/5.

The antenna 1 is formed in two layers stacked one over the other. The first antenna track portion 22 and fourth antenna track portion 32 are located in the lower plane 40 and the second antenna track portion 28 and the third antenna track portion 38 are located in the upper plane 42. The return bends 26 and 36 extend between the planes 40, 42.

If desired the first antenna track portion 22 and third antenna track portion 32 may be arranged perpendicular to the lower plane 40 instead of co-planar with it. In fact, any one or more of the first, second, third or fourth track portions may be arranged perpendicular to the ground plane but separated from it. The longitudinal portions of the first and second loops have a length 28 mm and the lateral portions of the first and second loops have approximate lengths 23 mm and 17 mm respectively. It is separated from the ground plane by 7 mm and has a volume of only 3 $cm^3$. The ground plane is 110 mm long and 40 mm wide.

The bandwidth and total efficiency of the antenna is increased by locating the antenna at the edges of the ground plane. It is further increased by extending the antenna track outside the ground plane along one or more edges so that it overhangs the ground plane. This improves coupling of the high Q small bandwidth resonant modes of the antenna and low-Q large bandwidth resonant modes of the ground plane. The upper edge of the antenna track is extended 1 mm over the edge of the ground plane. The left edge of the antenna track may also extend 1 mm over the left edge of the ground plane. The right edge of the antenna track may also extend 1 mm over the edge of the ground plane.

Other modifications may be made to the antennas 1 illustrated. For example, the position of the ground point 2 and feed point 3 can be moved to/from the centre and the ratios of the lengths of the longitudinal portions 54, 56 can be changed to compensate.

It is possible, to trade bandwidth for antenna height as decreasing the separation between the antenna track and the ground plane decreases the bandwidth.

Additional open-ended or short-circuited metal strips or suitable length may be connected or parasitically coupled at appropriate locations of the antenna to provide additional resonances and thus a wider bandwidth (or better impedance match and efficiency).

The orientation of the antenna on the ground plane can be changed, i.e. the antenna can be rotated e.g. 90, 180, or 270 degrees.

Figure 4:
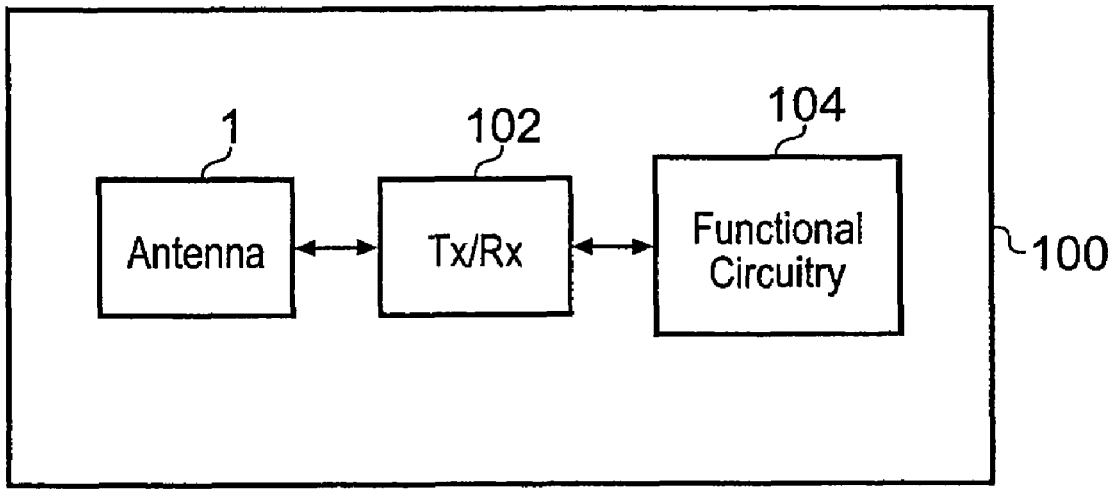
FIG. 4 illustrates a radio transceiver device comprising a multi-band antenna.

FIG. 4 illustrates a radio transceiver device 100 such as a mobile cellular telephone, cellular base station, or other wireless communication device. The radio transceiver device 100 comprises a multi-band internal antenna 1, as described above, radio transceiver circuitry 102 connected to the feed point of the antenna and functional circuitry 104 connected to the radio transceiver circuitry. In the example of a mobile cellular telephone, the functional circuitry 104 includes a processor, a memory and input/out put devices such as a microphone, a loudspeaker and a display. Typically the electronic components that provide the radio transceiver circuitry 102 and functional circuitry 104 are interconnected via a printed wiring board (PWB). The PWB may be used as the ground plane 10 of the antenna 1 and/or may be connected to another conductive object that acts as the ground plane 10.

The above-described capacitive loads may be electrically controlled. A switch and an additional capacitor if necessary can be added in series with the capacitive loads. When the switch is off the capacitive loading is less than when the switch is on. Thus when the switch is off the resonant frequencies will be higher than when the switch is on. This allows electrical control of the resonant frequencies of the modes, which allows impedance match optimization for different bands or compensation for external detuning effects such as detuning caused by the proximity of a user's body. This adjustable capacitive load can be added anywhere along the antenna track.

Metal strips can be connected between portions of the antenna. For example, the grounded and fed lateral portions can be connected to each other with a metal strip. This enables adjusting the input impedance level of the antenna. The input impedance level affects the level of impedance match at resonance.

In the preceding examples, the relative positions of the resonant frequencies of the antenna 1 have been engineered by selective reactive loading. In the examples, inductive loading in series with the antenna track and capacitive loading in parallel with the antenna track were used. However, it would also be possible to use as an alternative or as an addition capacitive loading in series with the antenna track and inductive loading in parallel with the antenna track. For example an inductive load could be connected between the antenna track and the ground plane. Such an inductive load may be a conductive, possibly meandering, strip. For example a capacitive load could be placed in series with the antenna track by leaving a gap in the track or as a capacitor in series with the track. In addition reactive loads may be placed in series and/or parallel with the feed point 2 and/or ground point 3.

Any of the mentioned reactive loads can be made electrically controlled. Such control can be achieved by adding a switch or other control device in series with the load. Turning the switch on and off will vary the loading causing a change in at least one of the resonant frequencies, which in turn will increase the effective bandwidth of the antenna. One example of such switched loading can be implemented by connecting the antenna track and the ground with a slightly inductive ground pin that is in series with a switch. The load can be placed anywhere along the antenna track, which extends between the feed and the original ground point. When the switch is on, the length of the antenna track is smaller and the resonant frequencies are higher than when the switch is off. This can extend the effective bandwidth of the antenna to cover e.g. the UMTS frequency range (1920-2170 MHz).

Although embodiments of the present invention have been described in the preceding paragraphs with reference to various examples, it should be appreciated that modifications to the examples given can be made without departing from the scope of the invention as claimed.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An antenna comprising:

a ground plane;

a feed point;

a ground point; and an antenna track extending between the feed point and the ground point and comprising, in series connection, a first loop and a second loop and having a first continuous band of operation and a second continuous band of operation, wherein the first continuous band of operation corresponds to a fundamental resonant frequency of the antenna, and the second continuous band of operation corresponds to the second and third harmonic resonances of the fundamental resonant frequency of the antenna, wherein the third harmonic is tuned, using reactive loading, towards the second harmonic; and wherein the antenna track has a length L, and the reactive loading comprises a first inductive load located at a position between L/5 and 2L/5 from the ground point and a second inductive load located at a position between 3L/5 and 4L/5 from the ground point.

2. The antenna as claimed in claim 1, wherein the antenna is shaped and arranged so that the fundamental resonant frequency and the second and third harmonic resonances couple to one or more resonances of the ground plane.

3. The antenna as claimed in claim 1, wherein the first continuous band of operation covers the GSM 850 band and/or GSM900 band and the second continuous band of operation covers the GSM 1800 band and/or GSM1900 band.

4. The antenna as claimed in claim 1, wherein the antenna track has a length L, and the reactive loading comprises a first inductive load located at a position where the electrical current associated with the third harmonic is greater than the electric current associated with the second harmonic.

5. The antenna as claimed in claim 1, wherein the reactive loading comprises a plurality of bends in the antenna track.

6. The antenna as claimed in claim 1, wherein the reactive loading comprises one or more capacitive loads positioned where the electrical field associated with the third harmonic is greater than the electric field associated with the second harmonic.

7. The antenna as claimed in claim 1, wherein the reactive loading comprises at least one capacitive load located substantially at a position between 2L/5 and 3L/5 from the ground point.

8. The antenna as claimed in claim 7, wherein a capacitive load is located at a position L/2 from the ground point.

9. The antenna as claimed in claim 1, wherein the antenna track is without bends where the electrical current associated with the second harmonic is significantly greater than the electric current associated with the third harmonic.

10. The antenna as claimed in claim 1, wherein the antenna track is without bends within the region between 2L/5 and 3L/5 from the ground point.

11. The antenna as claimed in claim 1, wherein the antenna track is without bends around L/2 from the ground point.

12. An apparatus comprising the antenna as claimed in claim 1.

13. An antenna comprising:

a ground plane;

a feed point;

a ground point; and an antenna track extending between the feed point and the ground point and comprising, in series connection, a first loop and a second loop and having a first continuous band of operation and a second continuous band of operation, wherein the first continuous band of operation corresponds to a fundamental resonant frequency of the antenna, and the second continuous band of operation corresponds to the second and third harmonic resonances of the fundamental resonant frequency of the antenna, wherein the third harmonic is tuned, using reactive loading, towards the second harmonic; and—wherein the antenna track has a length L, and the reactive loading comprises a first capacitive load positioned between L/5 and L/4 from the ground point and a second capacitive load positioned between 3L/4 and 4L/5 from the ground point.

14. The antenna as claimed in claim 13, wherein the first capacitive load is located at a first return bend of the first loop and the second capacitive load is located at a second return bend of the second loop.

15. An apparatus comprising the antenna as claimed in claim 13.

16. A method comprising:

providing an antenna having a plurality of resonant frequencies and including: a ground plane; a feed point; a ground point; and an antenna track extending between the feed point and the ground point and comprising, in series connection, a first loop and a second loop and having a first continuous band of operation and a second continuous band of operation, wherein the first continuous band of operation corresponds to a fundamental resonant frequency of the antenna, and the second continuous band of operation corresponds to the second and third harmonic resonances of the fundamental resonant frequency of the antenna, tuning the third harmonic, using reactive loading, towards the second harmonic wherein the antenna track has a length L, and the reactive loading comprises a first inductive load located at a position between L/5 and 2L/5 from the ground point and a second inductive load located at a position between 3L/5 and 4L/5 from the ground point.

17. The method as claimed in claim 16, further comprising arranging the antenna so that the fundamental resonant frequency and the second and third harmonic resonances couple to one or more resonances of the ground plane.

18. A method comprising:

providing an antenna having a plurality of resonant frequencies and including: a ground plane; a feed point; a ground point; and an antenna track extending between the feed point and the ground point and comprising, in series connection, a first loop and a second loop and having a first continuous band of operation and a second continuous band of operation, wherein the first continuous band of operation corresponds to a fundamental resonant frequency of the antenna, and the second continuous band of operation corresponds to the second and third harmonic resonances of the fundamental resonant frequency of the antenna, tuning the third harmonic, using reactive loading, towards the second harmonic;

wherein the antenna track has a length L, and the reactive loading comprises a first capacitive load positioned between L/5 and L/4 from the ground point and a second capacitive load positioned between 3L/4 and 4L/5 from the ground point.

19. A method as claimed in claim 18, wherein the first capacitive load is located at a first return bend of the first loop and the second capacitive load is located at a second return bend of the second loop.

* * * * *